United States Patent [19]

Ishikawa et al.

[11] 4,058,072

[45] Nov. 15, 1977

[54] EXTENSION TABLE FOR SEWING MACHINES

[75] Inventors: Hitoshi Ishikawa, Toyota; Kimihiko Yamamoto, Nagoya; Toshio Sawada, Okazaki; Takahiko Kasahara, Anjo, all of Japan

[73] Assignee: Aisin Seiki Kabushiki Kaisha, Japan

[21] Appl. No.: 742,102

[22] Filed: Nov. 16, 1976

[30] Foreign Application Priority Data

Nov. 25, 1975 Japan ..... 50-159669[U]

[51] Int. Cl.[2] ..... D05B 73/10

[52] U.S. Cl. ..... 112/258

[58] Field of Search ..... 112/260, 258, 217.1, 112/63; 312/208, 282, 277; 108/3, 90

[56] References Cited

U.S. PATENT DOCUMENTS

| | | | |
|---|---|---|---|
| 2,665,653 | 1/1954 | Theenhausen | 112/260 |
| 2,958,304 | 11/1960 | Arbib | 112/260 |

FOREIGN PATENT DOCUMENTS

| | | | |
|---|---|---|---|
| 1,030,156 | 5/1958 | Germany | 112/258 |

*Primary Examiner*—George H. Krizmanich

*Attorney, Agent, or Firm*—Pierce, Scheffler & Parker

[57] ABSTRACT

An extension table for attachment to a sewing machine head of the portable type for enlarging the somewhat limited working area provided by flat upper surface of the bed in which the bobbin mechanism is housed under the needle and presser foot wherein the table is pivotally mounted on a support structure associated with the machine in such manner as to enable it to be shifted between a vertical position along one side of the machine for storage with the latter within a case, and a horizontal working position co-planar with the upper surface of the bed. The table has an elongated L-shaped configuration and is mounted on the supporting structure in such manner that when in its horizontal working position the short and long sides thereof respectively lie adjacent the end and side walls of the machine bed.

6 Claims, 5 Drawing Figures

EXTENSION TABLE FOR SEWING MACHINES

BACKGROUND OF THE INVENTION

1. Field of the Invention

This invention relates to an improvement in an extension table adapted to be attached to a sewing machine head of the portable type for enlarging the somewhat limited flat working area provided by the upper surface of the bed in which the bobbin mechanism is housed under the needle and presser foot.

2. Description of the Prior Art

Conventionally, one type of the extension table, which is stood upon a support structure placed on the base plate of the sewing machine head at the front or rear side of the cylindric bed by being placed within the aperture of the support structure when stored within a case together with the machine head and is attached to the machine head by removing it from the support structure once and putting pins provided thereon into holes provided in the support structure and the machine head when the table is used, is well known.

The other type of extension table, which is hung on the inner wall of the case by folding legs when stored in the case, and is attached to the machine head by removing the same from the case once and putting the pins provided thereon into the holes provided in the machine head and standing up the legs again when the table is used, is well known.

Such types of extension table, however, results in complcated operation and mis-operation when stored in the case and are attached to the sewing machine head.

SUMMARY OF THE INVENTION

The object of the present invention is to provide an improved construction for an extension table for attachment to a sewing machine head of the portable type for enlarging the somewhat limited working area provided by the flat upper surface of the bed in which the bobbin mechanism is housed under the needle and presser foot, the table being pivotally mounted on a support structure associated with the machine in such manner as to enable it to be shifted between a vertical position along one side of the machine for storage with the latter within a case, and a horizontal working position co-planar with the upper surface of the bed. Thus the improved construction avoids those disadvantages which are inherent in prior known constructions.

BRIEF DESCRIPTION OF THE DRAWINGS

Various other objects, features, and attendant advantages of the present invention will be more fully appreciated as the same becomes better understood from the following detailed description of a preferred embodiment thereof and as illustrated in the accompanying drawings wherein.

DETAILED DESCRIPTION OF THE ILLUSTRATED EMBODIMENT

Figure 1:
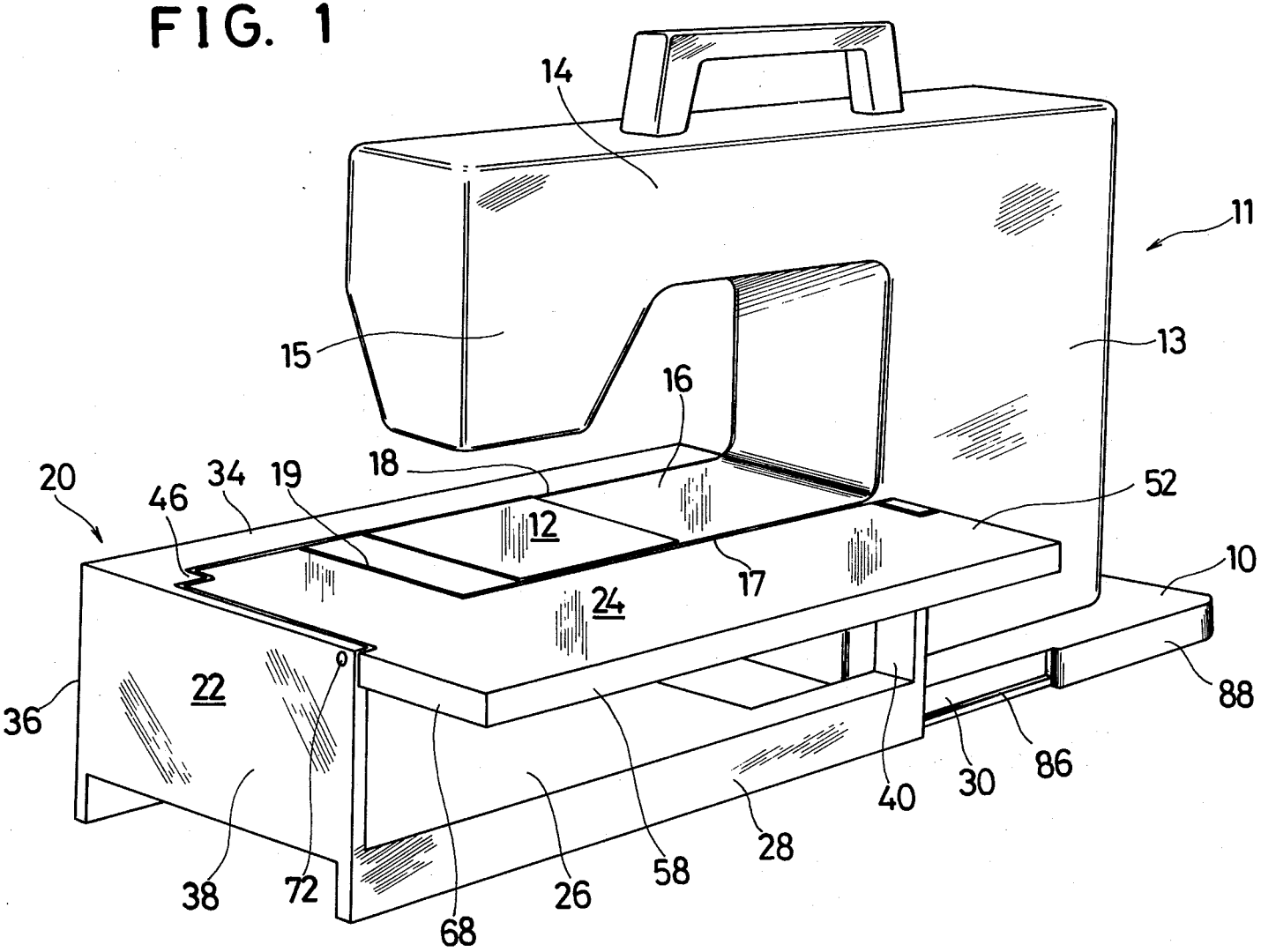
FIG. 1 is a perspective view of a sewing machine head of the portable type to which a pivotally mounted extension table in accordance with the invention has been attached, the table being shown in its horizontal working position flush with the surface of the machine bed.

Referring to the drawings, the machine base plate 10 supports the sewing machine 11 which comprises in usual fashion a cylindrical horizontal bed 12, in which a bobbin mechanism is housed, from which vertically extends a standard 13 which in turn supports a horizontal upper arm 14 generally parallel to the bed 12. A sewing head 15 at the free end of the arm 14 includes conventional sewing machine parts such as a needle bar, a presser bar, etc. However, the particular construction of these conventional components are not essential to the present invention and hence have not been included in the drawings in the interest of simplification. The cylindrical bed 12 has an upper wall 16, the upper surface of which is parallel to the upper surface of the base plate 10, a front wall 17, a rear wall 18 and an end wall 19.

Figure 4:
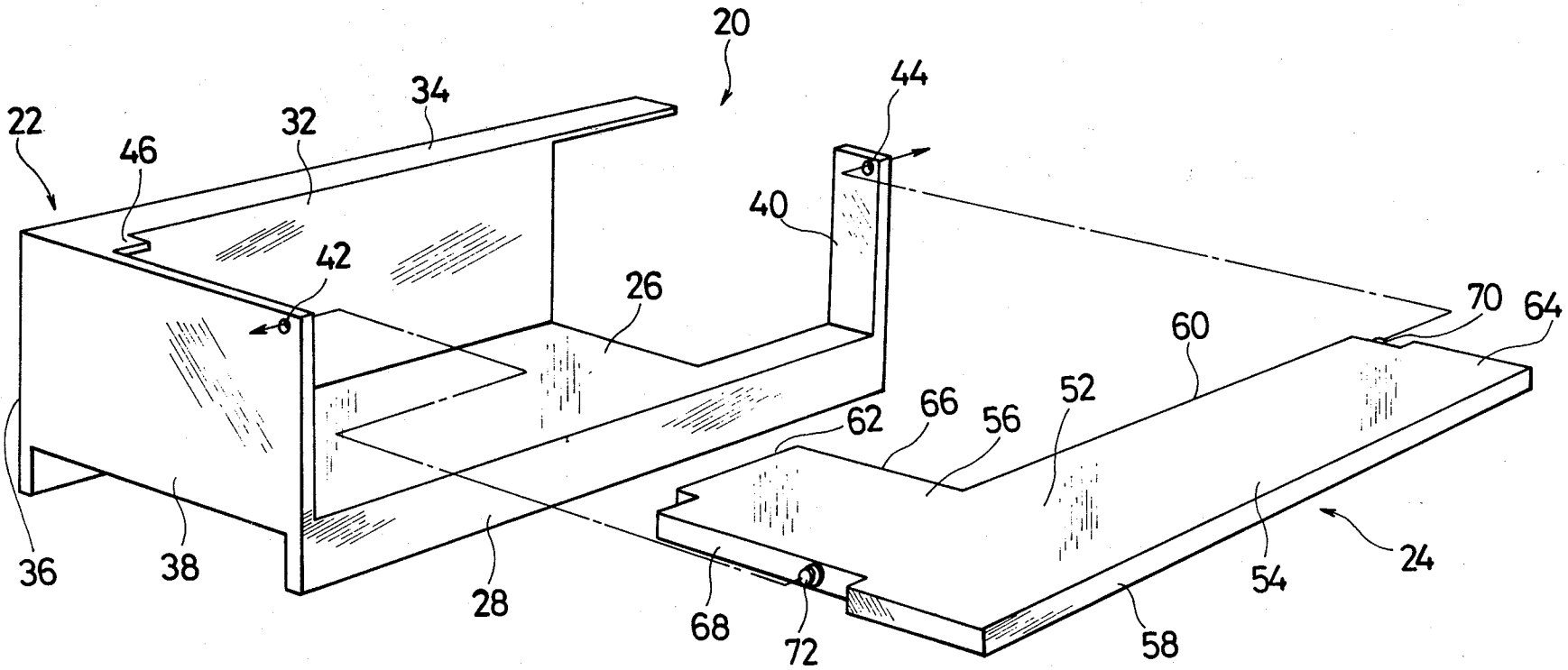
FIG. 4 is an exploded perspective view of the extension table and its box-like supporting structure and which discloses details of the pivotal mounting for the table.

The previously described cylindrical bed sewing machine 11 can be converted into a so-called flat bed sewing machine by the addition of an extension table arrangement designated generally by the numeral 20 which consists of a supporting box 22 and an extension table 24. The supporting box 22 has a bottom wall 26 which is placed on the upper surface of the base plate 10, a front vertical wall 28 which overlies the front side 30 of the base plate 10, an intermediate vertical wall 32 which extends vertically upwards from the rear end of the bottom wall 26 and lies adjacent to the rear wall 18 of the cylindrical bed 12, an upper wall 34 which extends horizontally from the upper end of the intermediate wall 32, the upper surface of the upper wall 34 being coplanar with the upper surface of the upper wall 16 of the cylindric bed 12, and a vertical rear wall 36 which extends vertically and downwardly from the rear end of the upper wall 34 and is parallel to the front wall 28, the under surface of the rear wall 36 being coplanar with the under surface of the front wall 28, the under end portion of the rear wall 36 overlying the rear surface of the base plate 10 to thereby embrace the base plate 10 in cooperation with the front vertical wall 28. As best seen in FIG. 4, the supporting box 22, furthermore, has a left end wall 38 and a right end wall 40, which are parallel to each other.

The left and right end walls 38 and 40 are formed with holes 42 and 44, respectively, the holes 42 and 44 being coaxial, the function of which will be described hereinafter.

Figure 5:
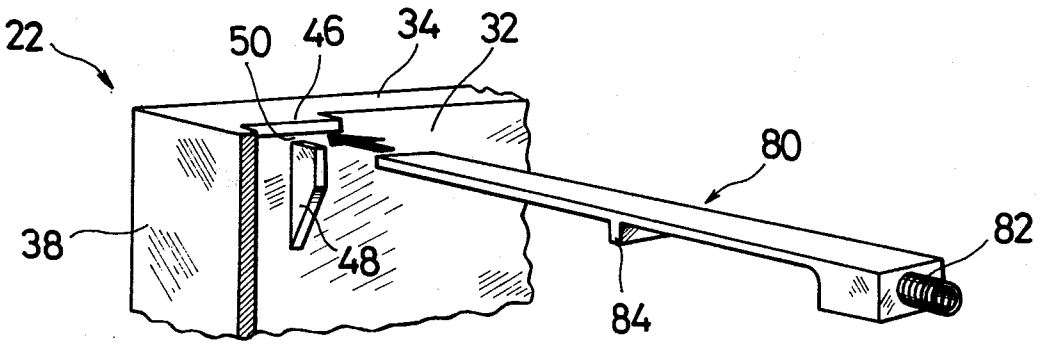
FIG. 5 is an exploded perspective view of details of the supporting structure for the extension table and mechanism on the latter for latching it in the horizontal working position.

Formed integrally with the upper wall 34 is a projection 46 at the left end and front side thereof. As best seen in FIG. 5, the intermediate wall 32 is provided with a vertical projection 48 having a sloping surface on the front surface thereof. A groove 50 is defined by the under surface of the projection 46 and the upper surface of the projection 48.

Figure 3:
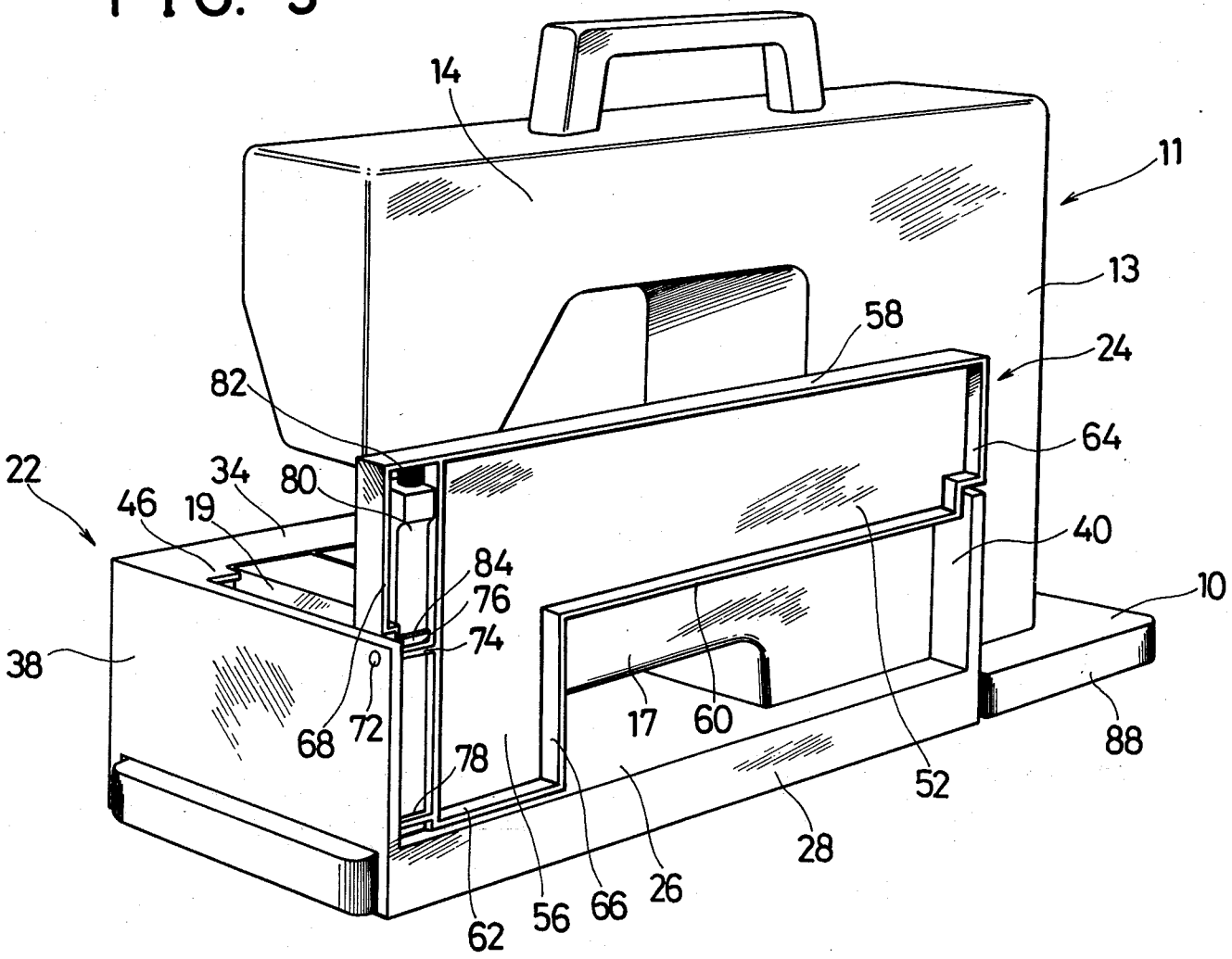
FIG. 3 is also a perspective view similar to FIG. 2 but showing the extension table and its support shifted to its final position on the machine enabling the latter to be stored within a case.

As best seen in FIG. 3, the extension table 24 comprises an L-shaped upper wall 52 having two portions 54 and 56 of different width, a front side wall 58, a rear side wall 60 of smaller width portion 54 which lies adjacent to the front wall 17 of the cylindric bed 12, when the extension table 24 is in working position, a stepped rear side wall 62 of larger width portion 56 having an offset portion which receives the projection 46 therein, a stepped right side wall 64 having an offset portion which receives the upper end portion of the right side wall 40 therein, a right side wall 66 of the larger width portion 56 which lies adjacent to the end wall 19, and a stepped left side wall 68 having an offset portion which receives the upper end portion of the left side wall 38 therein. The stepped left side wall 68 is of course equal to the combined lengths of the right side walls 64 and 66, and the front side wall 58 is similarly equal to the combined lengths of the rear side wall 60 and 62.

The portion 56 is equal to the combined widths of the cylindric bed 12 and portion 54, and the upper surface of the upper wall 52 is coplanar with the upper surface of the cylindric bed 12, when the extension table 24 is in working position.

The side walls 64 and 68 are formed with studs 70 and 72 at the offset portions thereof, respectively, the studs 70 and 72 being coaxial. As shown in FIG. 4, the studs 70 and 72 are received in the holes 44 and 42, respectively, by which the extension table 24 is pivotally secured to the supporting box 22. As best seen in FIGS. 3 and 4, the larger width portion 56 is formed with a rib 74 on the under surface thereof, the rib 74 being parallel to the wall of the offset portion of the wall 62. The rib 74 and the wall of the offset portion of the wall 62 are formed with rectangular holes 76 and 78, respectively. A securing plate 80 passes through the rectangular holes 76 and 78 to thereby slide on the under surface of the portion 56 along the side wall 68. A spring 82 is interposed between the front end of the securing plate 80 and the front wall 38 to bias constantly the securing plate 80 toward the rear side of the extension table 24. The securing plate 80 is formed with a rib 84 for limiting the rearward movement thereof by engagement of the rib 84 and the rib 76. When the rib 84 is in contact with the rib 76, the rear end surface of the securing plate 80 is coplanar with the outer surface of the rear side wall 62. When the extension table 24 is in working position, the rear end portion of the securing plate 80 is received in the groove 50 so as to secure the extension table 24 to the supporting box 22. When the extension table 24 is rotated by the studs 70 and 72 and is perpendicular to the bottom wall 26 of the supporting box 22, the upper surface of the extension table 24 lies adjacent to the front surface of the standard 13, as shown in FIG. 2.

Figure 2:
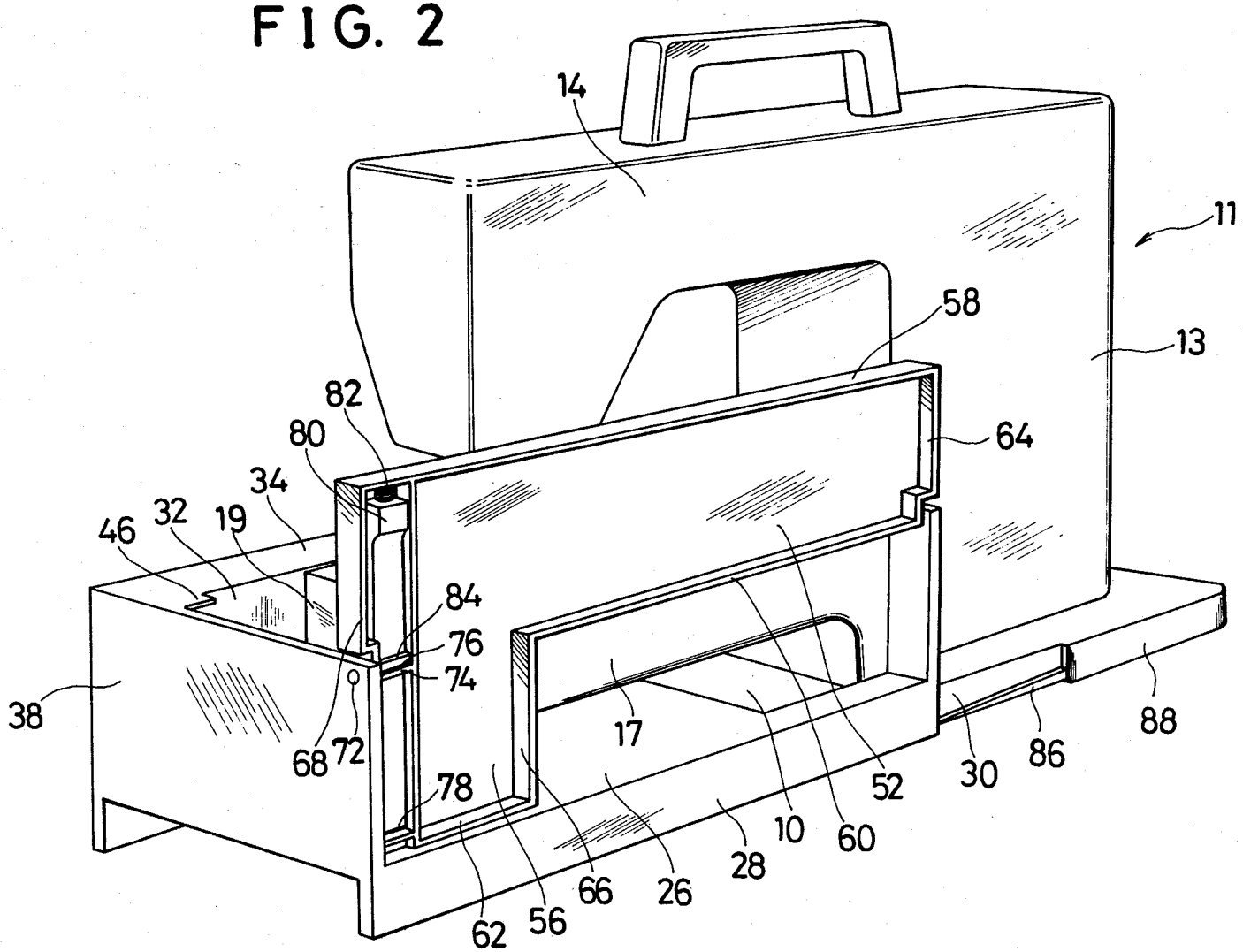
FIG. 2 is also a perspective view similar to FIG. 1 but showing the extension table shifted to its vertical position, this being an intermediate position preliminary to shifting the table and its support to a final position on the base plate of the machine for storing the machine within a case.

A wedge-shaped stop 86 is formed integrally with the base plate 10 on the front surface thereof, the wall 66 of the extension table 24 lying adjacent to the end wall 19 of the cylindric bed 12 when the right end of the wall 28 of the supporting box 22 is in contact with the left end of the stop 86 as shown in FIG. 2.

The base plate 10 is further provided with an enlarged portion 88 at the right end portion thereof to limit the rightward movement of the supporting box 22 on the base plate 10, as shown in FIG. 3.

The extension table operates as follows:

When the cylindrical bed 12 is to be used as a flat or planar bed, the extension table 24 is attached to the sewing machine 11 as will be described hereinafter.

The extension table 24, usually, is kept in perpendicular position to the bottom wall 26 of the supporting box 22 when the extension table 24 is not used.

In this state, the right end of the bottom wall 26 is placed on the left end of the base plate 10 by putting the latter between the front wall 28 and the lower end portion of the rear wall 36, and the supporting box 22 is slid onto the base plate 10 to the right until the right end of the wall 28 comes into contact with the left end of the stop 86, this state being shown in FIG. 2. The extension table 24 is then rotated in the clockwise direction in FIG. 2, about the studs 70 and 72, and consequently the rear-end of the securing plate 80 moves upwardly along the sloping surface of the projection 48 and into the groove 50 by the biasing force of the spring 82, whereby the extension table 24 is secured to the supporting box 22 in a state where the extension table 24 is parallel to the bottom wall 26 of the supporting box 22, i.e., the upper surfaces of the wall 34, the cylindric bed 12 and the extension table 24 are coplanar with one another as shown in FIG. 1. Therefore, the cylindric bed 12 can be used as part of the flat or planar bed. The extension table 24 is now in its working position.

When the extension table arrangement 20 and the sewing machine 11 are to be housed in a case, not shown, the securing plate 80 is pulled forwardly or inwardly toward the plane of the drawing paper (FIG. 1) so as to remove the end thereof from the groove 50 and the extension table 24 is rotated through 90° in the counter-clockwise direction about the studs 70 and 72 from the position as seen in FIG. 1 to the position as seen in FIG. 2. Then, if the extension table arrangement 20 is further moved to the right, the lower end of the wall 28 of the supporting box 22 will go up the sloped surface of the stop 86 and the end of the wall 28 will come into contact with the left end of the enlarged portion 88 resulting in the limitation of the rightward movement of the supporting box 22, which is the state seen in FIG. 3. In this state, if the operator covers the unit, the sewing machine 11 and the extension table arrangement 20 will be housed in the case.

Obviously, many modifications and variations of the present invention are possible in light of the above teachings. It is therefore to be understood that within the scope of the appended claims, the invention may be practiced otherwise than as specifically described herein.

We claim:

1. The combination with a sewing machine of the portable type upstanding upon a base plate, of an extension table arrangement for enlarging the working area provided by an upper flat surface of a raised bed of the machine in which the bobbin mechanism is housed, said extension table arrangement comprising a table, a support structure for said table slidable along said base plate between storage and working positions of said table, and means pivotally mounting said table on said support structure for movement from a vertical storage position along one side of said machine for storage with said machine within a case, to its horizontal working position co-planar with the upper surface of the machine bed, said table having an elongated L-shaped configuration oriented such that when said table occupies its horizontal working position the short and long sides thereof respectively lie adjacent the end and one frontwall of the bed of the machine.

2. An extension table arrangement as defined in claim 1 and which further includes latch means carried by said table and which are engagable with said table support structure when said table is moved to its horizontal position.

3. An extension table arrangement as defined in claim 1 wherein said support structure for said table includes a bottom wall slidable along the upper surface of said base plate and oppositely disposed walls depending from said bottom wall and which slidably engage opposite sides of said base plate.

4. An extension table arrangement as defined in claim 1 and wherein said support structure for said table also includes a side wall which terminates co-planar with the other side wall of the machine bed when said table occupies its horizontal working position.

5. An extension table arrangement as defined in claim 4 and which further includes latch means carried by said table and which are engagable with a groove provided in said side wall when said table is moved to its horizontal position.

6. An extension table arrangement as defined in claim 5 wherein said latch means is constituted by a latching plate slidably supported at the underside of said table and means for biasing said plate for automatic movement into said groove when said table is moved to its horizontal position.

* * * * *